United States Patent [19]

Wiernicki

[11] Patent Number: 4,526,518

[45] Date of Patent: Jul. 2, 1985

[54] FUEL PUMP WITH MAGNETIC DRIVE

[75] Inventor: Michael V. Wiernicki, Trumansburg, N.Y.

[73] Assignee: Facet Enterprises, Inc., Tulsa, Okla.

[21] Appl. No.: 655,316

[22] Filed: Sep. 27, 1984

Related U.S. Application Data

[63] Continuation of Ser. No. 285,908, Jul. 23, 1981, abandoned.

[51] Int. Cl.[3] ..... F04B 35/04; F01C 1/18

[52] U.S. Cl. ..... 417/420; 418/135; 418/171

[58] Field of Search ..... 417/420, 410; 418/61 B, 418/135, 171, 166, 170

[56] References Cited

U.S. PATENT DOCUMENTS

| | | | |
|---|---|---|---|
| 1,603,395 | 10/1926 | Möhl | 418/171 |
| 2,912,937 | 11/1959 | Insley | 418/15 X |
| 3,120,814 | 2/1964 | Mueller | 417/310 |
| 3,215,043 | 11/1965 | Huber | 418/61 B |
| 3,343,494 | 9/1967 | Erikson et al. | 418/135 X |
| 3,420,184 | 1/1969 | Englesberg et al. | 417/420 |
| 3,479,957 | 11/1969 | Cadman | 418/15 |
| 3,489,095 | 1/1970 | Eheim | 417/420 |
| 3,734,648 | 5/1973 | Nielson | 418/171 X |
| 3,741,690 | 6/1973 | Laing | 417/420 |
| 4,035,108 | 7/1977 | Laing | 417/420 X |
| 4,127,365 | 11/1978 | Martin et al. | 417/420 |

*Primary Examiner*—William L. Freeh
*Assistant Examiner*—Peter M. Cuomo
*Attorney, Agent, or Firm*—Remy J. VanOphem

[57] ABSTRACT

An axial air gap magnetic drive motor having a diaphragm to seal the drive motor from the pump is disclosed. The drive motor drives a positive displacement pump through a magnetic coupling on both sides of the diaphragm. The gerotor pump includes an annular backing plate member, an inlet member and a three piece pump which is rotated by the drive motor through the magnetic coupling. The three piece pump includes a male rotor gear, an annular female gear cooperatively engaging the male rotor gear and an outer annular member disposed around the annular female gear. The inside diameter of the outer annular member is eccentric a predetermined radial distance from the axial centerline. The outer annular member, the inlet member and the backing plate member are pinned to one another to prevent relative movement therebetween. A pair of biasing members are mounted between the opposite end of the housing and the inlet member to urge the inlet member towards the three piece pump and the backing plate member to reduce axial clearance therebetween.

11 Claims, 5 Drawing Figures

FUEL PUMP WITH MAGNETIC DRIVE

This is a continuation of application Ser. No. 285,908, filed July 23, 1981, now abandoned.

FIELD OF THE INVENTION

This invention relates to fluid handling devices and more particularly relates to magnetic drives employing driven positive displacement pumps for handling fluids.

BACKGROUND OF THE INVENTION

There are several known pumps of the type having an electric motor and a rotary wheel driven by the motor with a coupling consisting of two groups of permanent magnets to prevent contamination of the fluid being handled. One group of permanent magnets rotates with and is mounted on the shaft of the motor and the other group of magnets is mounted on and rotates with the rotor wheel. In these types of pumps, the interior of the pump is sealed against the environment by means of a diaphragm of nonmagnetic material disposed between the two groups of magnets. The rotor wheel is generally connected to a pump device.

In U.S. Pat. No. 2,970,548 to S. G. Berner, issued Feb. 7, 1961, a magnetically driven centrifugal pump is disclosed. The rotor wheel of the pump is coupled to an electric motor by two concentrically mounted magnets, one on the shaft of the motor and the other on the rotor wheel. Other examples of centrifugal pumps with concentrically mounted magnetic drives are shown in U.S. Pat. No. 3,205,827 to F. N. Zimmerman, issued Sept. 14, 1965 and U.S. Pat. No. 3,238,883 issued to Thomas B. Martin on Mar. 8, 1966. One disadvantage of concentrically mounted magnets is that the diaphragm wall must be made by welding a piece of sheet metal back on itself. However, in welding two thin edges of sheet metal, it is difficult to obtain a satisfactory seam or joint. Furthermore, it is difficult to fabricate the cylindrical wall to such an exact size and shape that the wall everywhere will be flush against the interface near the stator. In view of these considerations, the magnetic gap between concentrically mounted magnets must be substantially greater than comparable axially mounted magnets. Because of the increase in magnetic gap for concentrically mounted magnets, there is an undesirable increase in the loss of magnetic flux through the gap with a corresponding reduction in performance and the additional disadvantage of also requiring larger diameter components to handle higher torque transfers.

In U.S. Pat. No. 2,996,994 to G. W. Wright, issued Aug. 22, 1961, a submersible motor driven pump for pumping liquid fuels utilizing axial gap magnets is disclosed. This motor driven pump utilizes a centrifugal type rotor driven by a sealed motor through a magnetic coupling operating between an imperforate wall of the motor housing. The motor pump is adapted to fit within a variety of fuel tanks. The driving and driven members of the magnetic coupling lie on opposite sides of the imperforate wall, which serves as a rigid diaphragm between the two magnets. Thus, the driven and driving members are separated by an axial air gap. Another example of an axial air gap magnetic motor with a centrifugal pump is disclosed in U.S. Pat. No. 3,223,043 to Harris Shapiro issued Dec. 14, 1965.

Centrifugal pumps have a number of deficiencies. First, they are inherently high speed devices and are more efficient in handling large flows and low pressure rises. Centrifugal pumps have lower efficiencies for small flows and higher pressure rises. Secondly, the pressure rise developed by a centrifugal pump is directly proportional to the speed squared. Thus, centrifugal pumps do not produce high pressure rises at low speed. Third, centrifugal pumps have a tendency to cavitate and lose their prime. When either of these conditions occurs, the centrifugal pump will not pump which may result in generating heat, noise, vibration and the premature failure of the pump.

A further improvement in pumps having axial air gap magnetic drive motors is shown in U.S. Pat. No. 3,470,824 to Elton J. O'Connor, issued Oct. 7, 1969. O'Connor discloses a magnetic drive pump wherein an electrically powered drive motor is sealed from a pump chamber and transmits by electromagnetic forces, a rotary drive to a pump impeller in the pump chamber. The pump has sliding vanes in a fixed casing so that the liquid is directly displaced without requiring the application of centrifugal force.

One major drawback of positive rotary displacement pumps is that their efficiency is dependent on the machining clearances of rotating members. The actual clearance, of course, is a function of the machining and assembly. In addition, with low viscosity liquids, very close tolerances are necessary so as to reduce slippage caused by liquid leaking through the pump clearances. The amount of slip is dependent upon several factors. Generally, increased clearances result in greater slip. Thus, sliding vaned pumps do not find great application in pumping low viscosity liquids since the sliding vanes are prone to excessive tip wear which requires their frequent replacement. In addition, such sliding vane positive rotary displacement pumps are complex, have high friction losses, are expensive to make and do not provide a cut off in case of overpressurization of the fluid handled.

Therefore, none of the aforementioned centrifugal or sliding vane pumps, when used with a magnetic drive coupling between the pump and the electric motor, discloses a pump suitable for handling fuels. In addition, none of the aforementioned pumps are simple, inexpensive to make or provide overpressure protection to limit the discharge pressure of the fluid being handled. Finally, none of the aforementioned pumps are suitable for a multitude of fluids, including fuels, provide high pressure at low speed and voltage, have a low tendency to cavitate, can be easily assembled, and further provide high efficiency.

SUMMARY OF THE INVENTION

The present invention is directed to a pump with an axial air gap motor driving a positive displacement gerotor pump which provides positive lift at the inlet. In addition, the gerotor pump provides high pump efficiency without high friction and wear as heretofore has been experienced in the prior art designs. The pump is simple and is adaptable to the necessary manufacturing clearances at low cost. Furthermore, the present invention permits the use of increased axial clearances in assembling the pump without sacrificing pump efficiency or cost and is suitable for pumping multi-viscous fluids. Finally, the axial air gap gerotor pump prevents contamination of the fluid being handled and can easily be adapted to limit the discharge pressure of the fluid being handled.

The pump has a housing with a chamber having one end and an opposite end. The diaphragm member is mounted inside the chamber dividing the inside of the chamber into a first inside portion adjacent to one end and a second inside portion adjacent the opposite end. A first shaft is rotatably mounted in the first inside portion of the chamber. The shaft further has one end adjacent the diaphragm member with the opposite end having the electric motor mounted thereto for rotating the first shaft when energized. A second shaft is rotatably mounted in the second inside portion of the chamber. The second shaft has a first end adjacent the diaphragm member and a second end opposite the first end. A magnetic driving member is slidably and nonrotatably mounted on the one end of the first shaft adjacent to the diaphragm member. A magnetic driven member is fixedly mounted on the first end of the second shaft adjacent to but spaced away from the diaphragm member. The magnetic driven member rotates with the magnetic driving member in response to a force of magnetic attraction which is exerted between the magnetic driving and magnetic driven member through the diaphragm member. Finally, a gerotor pump member, which is mounted on the opposite end of the second shaft, pumps fluid when the second shaft is rotated.

It is, therefore, a primary object of this invention to provide a fluid pump having an axial magnetic coupling with a nonmagnetic diaphragm member therebetween which is coupled to a gerotor pump having an overpressurization limiter at the discharge port. The gerotor pump is designed to safely handle low viscosity fluids with high pump efficiency. Furthermore, the gerotor pump provides positive lift at the inlet, is self priming, and has multi-fluid capabilities. Finally, the losses created by fluid friction in the pump are minimized to enhance pump efficiency.

Other objects and features of the invention relating to the details of construction and operation will be apparent in the following description and the claims in which the principle of the invention is disclosed together with the best mode contemplated for carrying out the present invention.

DETAILED DESCRIPTION OF THE PREFERRED EMBODIMENT

Figure 1:
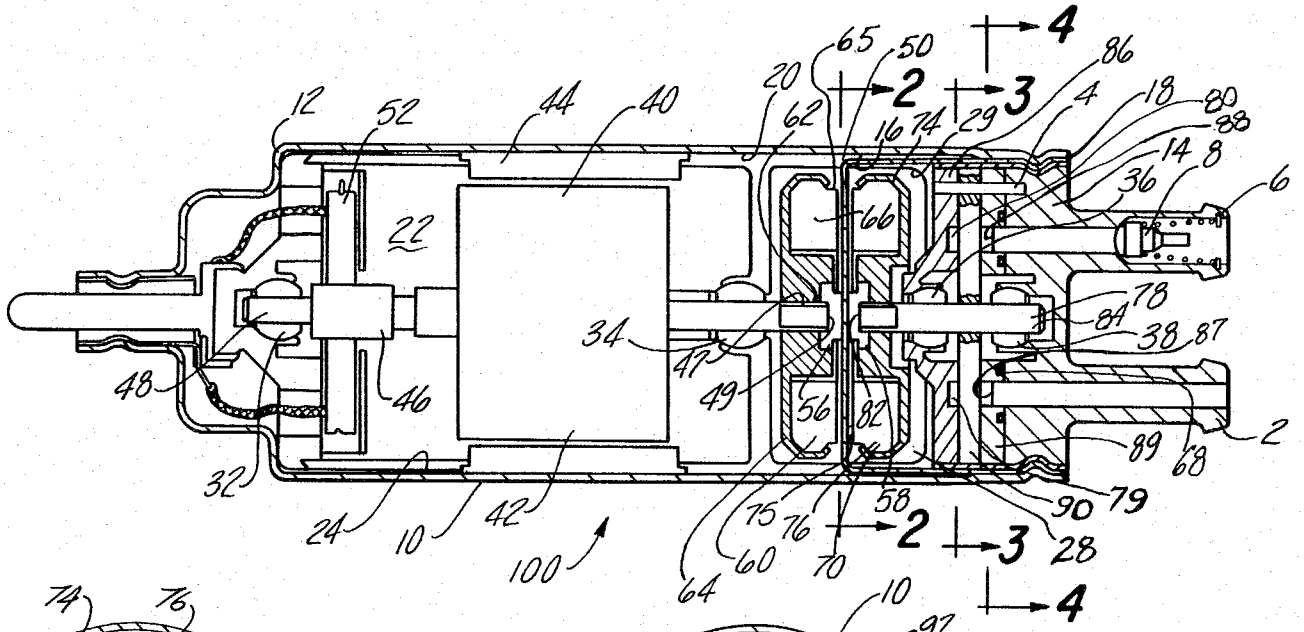
FIG. 1 is a partial sectional view of a magnetic pump according to the invention.

Referring to the drawings, there is shown a positive displacement, magnetic drive gerotor pump, generally designated by the numeral 100, which embodies the invention. The pump 100 is provided with a housing 10 with one end 12 and an opposite end 18. The housing 10 has a chamber 20 formed therein. A diaphragm member 50 is secured by suitable means such as welding to the inside diameter 16 of the housing 10 and divides the chamber 20 into a first inside portion 22 and an opposite second inside portion 28. The first inside portion 22 is formed adjacent to the one end 12 of the housing 10. The second inside portion is formed adjacent to the opposite end 18 of the housing 10. A pair of bearings 32 and 34 are suitably mounted to the inside diameter of the housing 10 in the first inside portion 22. The one bearing 32 is placed adjacent to the one end 12 and the other bearing 34 is placed adjacent the diaphragm member 50. An electric motor 40, having a drive shaft 48 extending from either side of an armature 42, is rotatably mounted on the bearings 32 and 34. Motor magnets 44 and field windings (not shown) are mounted concentrically with the armature 42. The motor magnets 44 and field windings are mounted to the inside diameter 24 of the first inside portion 22 of the chamber 20. The electric motor 40 also has a commutator 46 mounted adjacent the one bearing 32. A plurality of brushes 52 are conventionally connected to electrical contacts 54 which project through the one end 12 and are connected to an electric source (not shown). The brushes 52 are conventionally mounted onto the commutator 46 so as to provide electric current to the commutator and the armature 42. The field windings are also conventionally connected to the electric contacts (not shown) and thence to the electric source (not shown). The electric source may also be D.C. or alternating current with the appropriate modifications to the electrical components of the electric motor. Those skilled in the art will also recognize that the pump herein described need not be driven by electric source means in practicing the invention and that a hydraulic motor or an air motor may also be used with appropriate modifications.

The diaphragm member 50 is formed of a non-magnetic material for a purpose to be described herein later. The diaphragm member also constitutes a fluid seal to prevent fluid leakage between the first inside portion 22 and the second inside portion 28 of the chamber 20.

A first thrust button or washer 56 is mounted between the one end 49 of the drive shaft 48 and the diaphragm member 50. The washer abuts the diaphragm member 50 so as to prevent the one end 49 of the drive shaft 48 from rubbing against the diaphragm member and wearing through the diaphragm member.

An annular magnetic driving member 60 is mounted on the one end 49 of the drive shaft 48 adjacent to the first thrust washer 56. The magnetic driving member 60 is axially slidable on the shaft 48 by a plurality of flats 62 on the inside diameter of the magnetic driving member 60 and a plurality of cooperating flats 47 on the drive shaft 48. Thus, the magnetic driving member 60 may slide axially along the shaft 48 towards the diaphragm member 50 to compensate for production tolerances and wear of the first thrust washer 56 as required. The magnetic driving member 60 has an annular backing member 64 formed of suitable magnetically permeable material, preferably of steel. A permanent magnet 66, preferably a ceramic permanent magnet, is made into eight (8) poles and suitably mounted to the backing member 64 so as to be adjacent the first thrust washer 56 but spaced away from the diaphragm member 50. Thus, there is an air gap 65 between the diaphragm member 50 and the annular magnetic driving member 60 which varies somewhat as the first thrust washer 56 wears away.

In the second inside portion 28 of the chamber 20 is mounted a pair of bearings 36, 38 which are suitably mounted to the housing 10. A driven shaft 78 is mounted in the bearings 36, 38. The first end 82 of the second or driven shaft 78 is mounted adjacent to the diaphragm member 50 on bearing 36 and the second end 84 of the second shaft 78 is mounted on bearing 38 adjacent to the opposite end 18 of the housing 10.

A second thrust button or washer 58 is mounted between the first end 82 of the driven shaft 78 and the diaphragm member 50. The second thrust button or washer abuts against the diaphragm member 50 so as to prevent the first end 82 of the second shaft 78 from rubbing through and wearing against the diaphragm member 50.

A magnetic driven member 70 is fixedly mounted on the second shaft 78 for rotation therewith. The magnetic driven member 70 has an annular backing member 74 formed of suitable magnetically permeable material, preferably of steel. A permanent magnet 76, preferably a ceramic permanent magnet is made to have eight (8) poles and suitably mounted to the backing member 74 so as to be adjacent to the second thrust washer 58 but spaced away a predetermined distance to form a fixed air gap 75 from the diaphragm member 50. Those skilled in the art will recognize that any equal number of magnets may be used in the magnets 66, 76 respectively in order to provide a magnetic coupling between the magnetic driven member and the magnetic driving member. It is important, however, that one of the magnets 66 of the driving member 60 be aligned with the corresponding one of the magnets 76 on the driven member 70. This permits the driving member 60 and the driven member 70 to be coupled by the flux path emitted by the magnetic attractions of one of the magnets 66 through the air gap 65, through the diaphragm member 50, through the air gap 75 and then to one of the magnets 76. Thus, the magnets 66 are always aligned with the magnets 76 and thus, no slippage occurs between the driving and driven members when one is rotated relative to the other. Slippage between the magnets 66, 76 respectively occurs if a force overcomes the magnetic force therebetween such as in the event that the pump is prevented from rotation.

Figure 3:
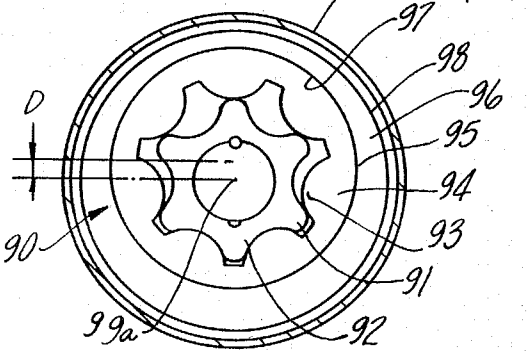
FIG. 3 is a sectional view along 3—3 of FIG. 1.
Figure 2:
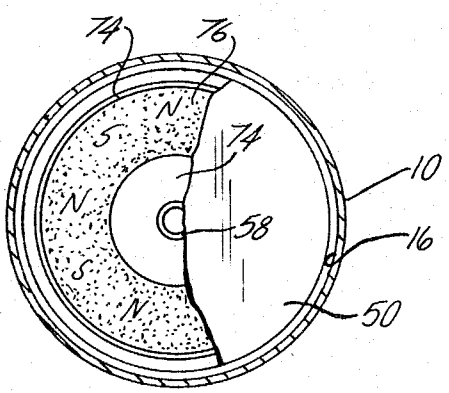
FIG. 2 is a section view along 2—2 of FIG. 1 of the gerotor pump of the invention.
Figure 5:
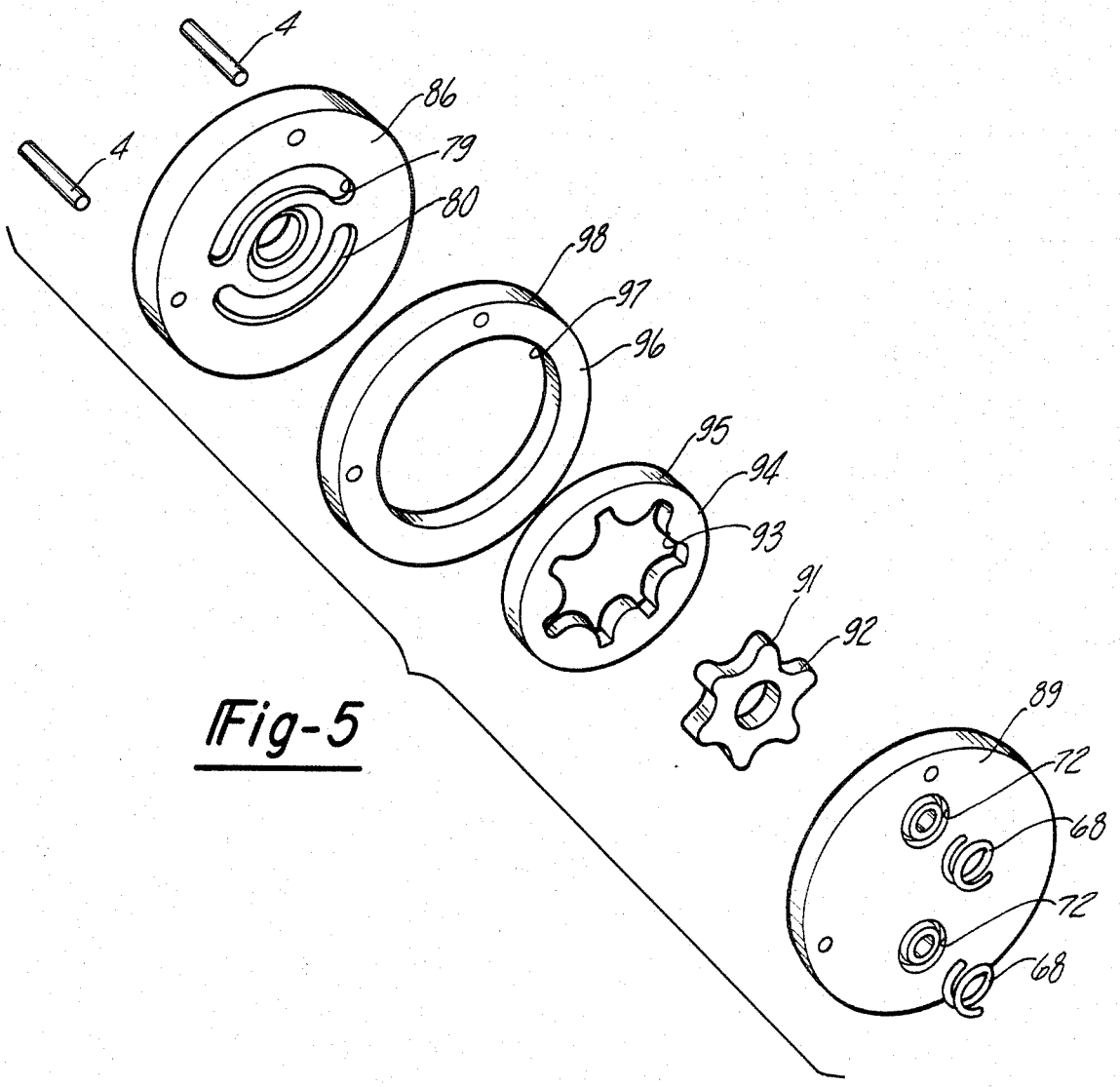
FIG. 5 is a perspective view of a gerotor pump arrangement.

On the second shaft 78 adjacent the second end 84 is mounted a gerotor pump 90. The gerotor pump is made of an annular backplate member 86, an inlet annular member 89 and three (3) cooperating positive displacement members, that is, a male rotor gear 92, an annular female member 94 and an outer annular member 96 as is best shown in FIGS. 3 and 5.

The annular backplate member 86 is connected to the inside diameter of the second inside portion 28. The backplate member 86 has one face mounted adjacent to the driven member 70. The opposite face has two kidney shaped cavities 78, 80 formed one opposite the other therein for a purpose to be described later on herein. The second shaft 78 passes through the inside diameter of the backplate member 86. The three aforementioned cooperating members 92, 94 and 96 respectively are centrally mounted relative to the axis of the second shaft 78 so as to abut the annular backplate member 86. The male rotor gear 92 is concentrically and axially slidable and nonrotatably mounted to the second shaft. The annular female gear member 94 cooperatively engages the male rotor gear 92. The outer annular member 96 is mounted to the inside diameter 29 of the second inside portion 28 of the chamber 20. The inside diameter 97 of the outer annular member 96 is eccentric a predetermined radial distance D from the longitudinal axis 99*a* passing through the centerline of the outer diameter 98 of the outer annular member 96 for a purpose to be discussed later on herein.

The annular female gear member 94 has an outer diameter 95 which mounts within the inside diameter 97 of the outer annular member 96. The outer diameter 95 is formed so as to be undersized with the inside diameter 97 to provide a slight diametral clearance between the two members. This diametral clearance, formed between the two members, permits the female gear member 94 to float in the outer annular member 96. The annular female gear member 94 has an inner annular tooth profile 93. The inner annular tooth profile is made with one more gear tooth than the teeth 91 on the male rotor gear 92.

The male rotor gear 92 rotates concentrically on the second or driven shaft 78. The teeth 91 on the male rotor gear 92 mesh with the inner annular tooth profile 93 of the female gear member 94 so that both the male gear 92 and the female gear member 94 rotate in the same direction. The male gear 92, however, advances one tooth each revolution of rotation. As the female gear member rotates with the male gear membr 92, the teeth mesh and demesh because of the eccentric radial distance D of the inside diameter 97 relative to the outer annular member 96.

Figure 4:
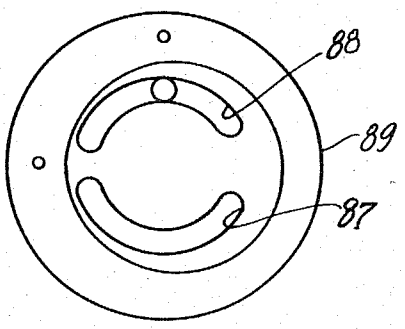
FIG. 4 is a sectional view along 4—4 of FIG. 1.

The gerotor pump 90 is mounted between the annular backplate member 86 and the inlet member 89. The inlet member has two kidney shaped cavities or openings 87, 88 respectively serving as inlet and outlet openings to the housing 10. Each of the kidney shaped openings 87, 88 are in axial alignment with each of the kidney shaped cavities 79, 80 in the annular backplate member 86. The inlet member is slidably mounted to the inside diameter of the second inside portion 28 of the housing 10. The inlet member is suitably mounted to the inside diameter of the second inner portion of the housing 10 so that the inlet member is prevented from rotation with the gerotor pump 90. One of the two kidney shaped cavities 87 is positioned in the top half portion of the inlet member 89 and the second kidney shaped cavity 88 is positioned in the lower half as is shown in FIG. 4. In addition, the annular backplate member 86, the outer annular member 96 and the inlet member 89 are connected together by at least two pins 4 as is well known in the art to prevent relative movement therebetween.

As discussed earlier, the outer annular member 96 has an inside diameter 97 which is eccentric a distance D to the horizontal diametral axis 99*a* passing through the centerline of the outer diameter 98 as shown in FIG. 3. The eccentric D is positioned above the diametral axis 99*a* which splits the upper half of the inlet member 89 from the lower half of the inlet member.

An inlet port 2 is formed in an end plate member 14 mounted on the opposite end 18 of the housing 10 so as to connect the inlet to the kidney shaped cavity 87 for flow communication thereto. Similarly, an outlet port 6 is formed in the end plate member 14 mounted on the opposite end 18 of the housing 10 so as to connect the outlet to the kidney shaped opening 88 for flow communication thereto. When the gerotor pump 90 is rotated, the meshing and demeshing of the teeth causes the fluid to be pumped to be drawn into the volume between the male rotor gear 92 and the female gear member 94. The inlet port 2 thus provides an inlet fluid passage which is connected by suitable conduit means to the fluid to be pumped (not shown). The outlet port 6 is connected by suitable conduit means to a receiver (not shown) which receives the pressurized fluid from the pump 100. A one way fluid flow device 8, such as a conventional check valve, is provided to insure one way fluid flow from the gerotor pump through the outlet port 6 and also to prevent bleed down when the pump 100 is deactivated.

The efficiency of any positive displacement pump such as herein described depends on the axial clearances of the members. In order to insure minimum axial clearance between the three cooperating gerotor pump members 92, 94, and 96, respectively, the inlet member 89 is biased towards the gerotor pump as shown in FIG. 5. For this purpose, a pair of spaced apart cavities 72 are formed in the inlet member 89 adjacent to the opposite end 18 of the housing 10. In each cavity 72 is placed a resilient or biasing member 68, which in the preferred embodiment is a spring biasing member, such as a helical spring. The resilient member 68 thus biases the inlet annular member toward the gerotor pump members 92, 94 and 96 and assures minimum axial clearance between the gerotor pump members 92, 94 and 96 respectively and the inlet annular member 89 and the back plate member 86.

OPERATION

When the operation of the pump 100 is desired, the electric motor 40 is connected to the electric source (not shown).

When the motor rotates, fluid is drawn through the inlet port 2 which communicates with the inlet kidney shaped opening 87. Fluid is drawn into the female gear member 94 and the kidney shaped cavity 79 when the male rotor 92 meshes against the annular female gear member 94 and, simultaneously, fluid is expelled from the annular female gear member 94 and the kidney shaped cavity 80 through the outlet kidney shaped opening 88 and thence into the outlet port 6. The meshing action, which occurs upon rotation of the male rotor gear 92 coacting with the inner annular tooth profile 93 of the female gear member 94, creates a series of alternately expanding and contracting chambers therebetween. This action causes a positive fluid displacement when the pump is in fluid communication with the appropriate inlet and outlet ports. The conjugately generated tooth profiles of the male and female gear members are in continuous fluid contact during operation. Thus, upon one complete revolution of the inner member, the male rotor will have advanced one tooth with respect to the female gear member. The volume of fluid displaced in one revolution is proportional to the size of the male rotor, the degree of offset D with respect to the female member and the thickness of the pump. Thus, the pump 100 provides good lift characteristics since fluid is drawn into the unmeshed space between members 92, 94 respectively, immediately upon relative rotation of the members 92, 94. The electrical power input through the contacts leading to the motor causes rotation of the magnetic driving member 60 through the cooperating flats 62, 47 on the drive shaft 48. As previously indicated, the magnetic driving member 60 has a sliding fit on the shaft 48 so that changes in axial location of the armature of the motor will not increase or decrease the rubbing pressure of the magnetic driving member 60 against the diaphragm member 50. The magnetic forces of the magnetic driving member 60 are transmitted through the air gap 65, through the diaphragm member 50, through the air gap 75 and then to the magnetic driven member 70 which is freely rotatable on the second shaft 78. The second thrust washer 58 prevents the driven shaft 78 from rubbing against the diaphragm member 50. Thus, the driving member 60 causes the driven member 70 to rotate whenever the driving member is rotated by the motor.

In the event that pressure develops in the outlet 6 cooperating with the kidney shape cavity 88 of the pump to a greater degree than is desired, the inlet member 89 will move axially away from the gerotor pump members 92, 94 and 96. The inlet member 89 moves axially away from members 92, 94 and 96 by pressing against the biasing member 68 towards the opposite end 18 of the pump. As this occurs, the fluid being pumped is permitted to pass from the outlet of the kidney shaped opening 88 to the inlet of the kidney shaped opening 87 thereby relieving the pressure in the fluid. The degree of biasing by the biasing member 68 can be varied to match the desired maximum outlet pressure that is to be generated by the pump 100.

Those skilled in the art will recognize that the pump described herein can be used to pump low and high viscosity fluids. Furthermore, the pump will stop pumping in the event that debris or some other foreign matter is drawn into the pump members 92 and 94 to prevent rotation of the gerotor pump 90.

While the invention has been described with the preferred embodiment, it should be understood that it is not intended to limit the invention to that embodiment. On the contrary, it is intended to cover all alternatives, modifications and equivalents which may be included within the spirit and scope of the invention as defined by the appended claims.

What is claimed is:

1. A compact fluid pump comprising:

a cylindrical housing having an open end, a closed end, and an axis of symmetry;

a planar non-magnetic diaphragm disposed in said housing normal to said axis of symmetry, said non-magnetic diaphragm dividing the interior of said housing into a motor chamber and a pump chamber;

an annular stator attached to the internal periphery of said housing in said motor chamber intermediate said non-magnetic diaphragm and said closed end of said housing;

an armature rotatably journalled in said motor chamber, said armature further being concentrically mounted relative to said annular stator, said armature having a motor shaft extending in a direction toward said non-magnetic diaphragm;

an annular drive magnet slidably attached to said motor shaft, said annular drive magnet further being disposed parallel to said non-magnetic diaphragm, said drive magnet having a plurality of alternating north and south magnetic poles disposed about its periphery adjacent to said non-magnetic diaphragm;

a pump shaft rotatably journalled in said pump chamber of said housing, said pump shaft further being concentrically mounted relative to said motor shaft of said armature;

an annular driven magnet attached to said pump shaft, said annular driven magnet further being parallel to said non-magnetic diaphragm in said pump chamber, said annular driven magnet having a plurality of alternating north and south poles disposed about its periphery and adjacent to said non-magnetic diaphragm, said plurality of alternating north and south poles of said annular driven magnet being equal to and magnetically coupled to said plurality of alternating north and south magnetic poles of said annular drive magnet through said non-magnetic diaphragm to rotate therewith;

gerotor pump means attached to said housing in said pump chamber, intermediate said non-magnetic diaphragm and said open end of said housing, said gerotor pump means further being driven by said pump shaft, said gerotor pump means having an inlet aperture and an outlet aperture; and an end cap disposed about said open end of said housing enclosing said gerotor pump means, said end cap having an input port communicating with said inlet aperture and an outlet port communicating with said outlet aperture.

2. The fluid pump of claim 1 wherein said gerotor pump means comprises:

an annular backplate member fixedly mounted within said pump chamber adjacent to said annular driven magnet on the side opposite said non-magnetic diaphragm, said backplate member having an aperture rotatably receiving said pump shaft therethrough;

an inlet member disposed within said pump chamber, said inlet member having a fluid entrance port, a fluid exit port and an axial aperture receiving said pump shaft therethrough;

a male rotor gear having a predetermined number of teeth disposed between said backplate member and said inlet member, said male rotor gear being fixedly attached to said pump shaft and rotatable therewith;

an annular outer member disposed between said backplate member and said inlet member circumscribing said male rotor gear, said annular outer member having an offset internal diameter and aperture therethrough offset from the axis of said pump shaft;

a female rotor gear having an inside diameter, said female rotor gear being disposed between said annular outer member and said male rotor gear, said female rotor gear further having a second predetermined number of teeth, said second predetermined number of teeth being at least one more tooth than the predetermined number of teeth of said male rotor gear, said second predetermined number of teeth being provided about its internal diameter;

said female rotor gear further having a circular outer diameter slidably received in said offset internal diameter of said outer member; and means for non-rotatably connecting said annular backplate member, said inlet member, and said annular outer member.

3. The fluid pump of claim 2 further comprising resilient means provided between said end cap and said inlet member to produce a force urging said inlet member and said annular outer member against said annular backplate member.

4. The fluid pump of claim 3 further comprising a check valve disposed in said outlet port to provide unidirectional fluid flow through said outlet port.

5. A fluid pump comprising:

a cylindrical housing defining an internal cavity having a closed end, an open end, and an axis of symmetry;

a planar non-magnetic diaphragm disposed in said housing normal to said axis of symmetry, said planar non-magnetic diaphragm dividing said internal cavity into a motor chamber adjacent to said closed end and a pump chamber adjacent to said open end;

an electric motor disposed in said motor chamber; said electric motor having a motor shaft concentric with said housing and extending adjacent to said planar non-magnetic diaphragm;

an annular drive magnet attached to said motor shaft parallel to said planar non-magnetic diaphragm, said annular drive magnet having a plurality of alternating magnetic poles disposed about a radial periphery, said plurality of alternating magnetic poles extending from said annular drive magnet in a direction towards said planar non-magnetic diaphragm so as to be positioned adjacent to said planar non-magnetic diaphragm;

gerotor pump means attached to said cylindrical housing within said pump chamber, said gerotor pump means having a pump shaft concentric with said motor shaft and extending adjacent to said planar non-magnetic diaphragm, said gerotor pump means further having a fluid entrance port and a fluid exit port;

an annular driven magnet attached to said pump shaft parallel to said planar non-magnetic diaphragm, said annular driven magnet having a plurality of alternating magnetic poles disposed about a radial periphery, said plurality of alternating magnetic poles extending from said annular driven magnet in a direction towards said planar non-magnetic diaphragm so as to be positioned adjacent to said planar non-magnetic diaphragm, said annular driven magnet further being coupled to said annular drive magnet through said planar non-magnetic diaphragm to rotate said pump shaft with the rotation of said motor shaft; and an end cap attached to said cylindrical housing and enclosing said pump chamber, said end cap having an inlet port communicating with said fluid entrance port and an outlet port communicating with said fluid exit port.

6. The fluid pump of claim 5 wherein said electric motor further comprises:

an annular stator connected to the internal periphery of said housing intermediate said closed end and said planar non-magnetic diaphragm;

an armature attached to said motor shaft concentric with said annular stator; and a pair of journals attached to said housing, one located either side of said armature, said pair of journals rotatably supporting said motor shaft.

7. The fluid pump of claim 6 wherein said annular driven magnet is slidably attached to said motor shaft for linear displacement therealong.

8. The fluid pump of claim 5 wherein said gerotor pump means further comprises:

a backplate attached to said housing adjacent to said annular driven magnet, said backplate having a first shaft aperture rotatably receiving said pump shaft therethrough;

an inlet member displaced from said backplate, said inlet member having a second shaft aperture rotatably receiving said pump shaft therethrough;

an intermediate annular member disposed between said backplate and said inlet member, said annular member having an internal aperture whose axis is offset from the axis of said pump shaft;

an annular female gear having an external diameter rotatably received in said internal aperture of said intermediate annular member, said annular female gear having a plurality of gear teeth;

a male gear attached to said pump shaft, said male gear having a plurality of external teeth, said plurality of external teeth being at least one less than said plurality of internal teeth of said female gear, said plurality of external teeth of said male gear engaging said plurality of internal teeth of said female gear along a predetermined radii passing through the axis of said pump shaft and the axis of said internal aperture of said intermediate annular member; and means for non-rotatably joining said inlet member and said intermediate annular member with said backplate.

9. The fluid pump of claim 8 wherein said inlet member and said intermediate annular member are slidably mounted in said non-rotatably joining means and wherein said fluid pump further comprises resilient means disposed between said end cap and said inlet member for biasing said inlet member and said intermediate annular member against said backplate.

10. The fluid pump of claim 9 further comprising a check valve disposed in said outlet port of said end cap providing a unidirectional fluid flow through said gerotor pump means.

11. The fluid pump of claim 6 wherein said housing further comprises means for providing electrical power source to said stator and said armature.

* * * * *

UNITED STATES PATENT AND TRADEMARK OFFICE

CERTIFICATE OF CORRECTION

PATENT NO. : 4,526,518

DATED : July 2, 1985

INVENTOR(S) : Michael V. Wiernicki

It is certified that error appears in the above-identified patent and that said Letters Patent is hereby corrected as shown below:

Column 5, line 46, delete "78, 80" and insert ---- 79, 80 ----.

Column 6, line 26, after "diameter" insert ---- 29 ----.

Column 9, line 65, delete the semicolon ";" and insert a comma ---- , ----.

Signed and Sealed this

*Fifth* Day of *November 1985*

[SEAL]

*Attest:*

*Attesting Officer*

DONALD J. QUIGG

*Commissioner of Patents and Trademarks*